United States Patent [19]

Kato et al.

[11] Patent Number: 4,719,879

[45] Date of Patent: Jan. 19, 1988

[54] INTAKE MANIFOLD

[75] Inventors: Seiji Kato, Saitama; Masayuki Kumada, Tokyo, both of Japan

[73] Assignee: Honda Giken Kogyo Kabushiki Kaisha, Tokyo, Japan

[21] Appl. No.: 790,032

[22] Filed: Oct. 22, 1985

[30] Foreign Application Priority Data

Oct. 23, 1984 [JP] Japan ..... 59-221213
Oct. 23, 1984 [JP] Japan ..... 59-159162[U]

[51] Int. Cl.[4] ..... F02B 75/18
[52] U.S. Cl. ..... 123/52 M; 123/59 R
[58] Field of Search ..... 123/52 M, 52 MC, 52 MV, 123/52 MB, 59 R

[56] References Cited

U.S. PATENT DOCUMENTS 3,448,729 6/1969 Parsons ..... 123/52 M
3,945,357 3/1976 Ableitner ..... 123/52 M
4,175,504 11/1979 Ederer et al. ..... 123/52 MV
4,183,332 1/1980 Hofbauer et al. ..... 123/52 M
4,228,769 10/1980 Gartner et al. ..... 123/52 M
4,232,640 11/1980 Matsumoto et al. ..... 123/308
4,409,934 10/1983 Kaindl ..... 123/59 R
4,461,248 7/1984 McFarland ..... 123/52 MV

FOREIGN PATENT DOCUMENTS 113441 7/1984 European Pat. Off. ..... 123/52 M

*Primary Examiner*—Craig R. Feinberg
*Attorney, Agent, or Firm*—Lyon & Lyon

[57] ABSTRACT

An intake manifold for multicylinder, in-line type engine wherein a distribution chamber extends along the engine and a separate intake pipe extends from the distribution chamber to each intake port for each engine cylinder. When the engine has an oval intake port, usually because of two intake valves, with the major axis extending the length of the engine, the intake pipes have matching oval openings. The connection between each intake pipe and the distribution chamber is oval in shape but oriented with the major axis extending laterally to reduce the length of the distribution chamber. The walls of the manifold vary in thickness for reducing weight and the moment of inertia by progressively decreasing the wall thickness in the direction away from the engine.

19 Claims, 5 Drawing Figures

INTAKE MANIFOLD

This invention relates to an intake manifold for an internal combustion engine and, in particular, to a multi-cylinder, in-line type engine having at two intake valves in each cylinder.

Conventionally, an intake manifold generally includes a distributing chamber which is parallel to the row of cylinders and one intake pipe branching from the chamber for each cylinder. There are numerous factors which must be considered in the design and construction of an intake manifold, which factors are not always compatible.

For example, it is desirable to use a circular cross section and avoid any rapid change in the shape of the cross section of the intake pipe for air flow efficiency and yet obtain the optimum charging efficiency when each intake pipe is connected to a cylinder having a plurality of intake valves arranged in a non-circular combination. The cross section of the intake port of each cylinder having two intake valves is preferably in a shape which unites two adjacent branching passages within the cylinder head to which each intake valve is connected and therefore the intake port is in a substantially oval shape with the major axis disposed in alignment with the row of cylinders. Thus the cross section of the end portion of each intake pipe connecting to the intake port must be oval with the major axis also disposed in alignment with the row of cylinders.

However, if the cross section of each intake pipe is made an oval with the major axis thereof disposed in alignment with the row of cylinders and this configuration extends over the entire length of the intake pipe, the length of the distributing chamber is increased and, in turn, the length of the intake system which includes a throttle body attached to the longitudinal end portion of the chamber becomes greater than the length of the row of cylinders of the engine whereby the overall length of the engine is unnecessarily enlarged in size.

Additional factors to be considered in the design and construction of an intake manifold are the weight and moment of inertia. Excess weight in any vehicle component is undesirable from cost and efficiency standpoints. Further, since an engine vibrates, the moment of inertia of the intake manifold and the distance of the center gravity from the engine are important to the vibration characteristics and the durability of the manifold and other components. Reducing the wall thickness of the manifold reduces weight and moment of inertia but may adversely effect the durability.

Accordingly, it is an object of this invention to provide an intake manifold having a novel shape and design which provides an efficient air induction system in a compact and light weight arrangement.

Another object of this invention is to provide an intake manifold with intake pipes having oval openings to match the oval intake ports for each cylinder having two intake valves and progressively varying the shape of the intake pipe cross section to minimize the overall length of the manifold. A still further object of this invention is to provide such an intake manifold wherein the upstream end of each intake pipe has a funnel shape opening into the distribution chamber and the funnel shape flares toward the engine to minimize the overall size of the manifold.

Still another object of this invention is to provide such an intake manifold with varying wall thicknesses wherein thinner walls are provided remote from the engine to minimize the weight and to locate the center of gravity as close as possible to the engine.

Other and more detail objects and advantages of this invention will readily appear to those skilled in the art from the following description of the preferred embodiment and the accompanying drawings, wherein.

This invention is shown and will be described in connection with a four cylinder engine with the intake valves for each cylinder arranged in a line along one side of the engine although it will readily appear to those skilled in the art that the invention is also applicable to other internal combustion engine arrangements. Further, the engine will be described as it would be positioned in a front wheel drive vehicle with the crankshaft extending laterally of the vehicle whereby in the top plan view of FIG. 1 the rear of the vehicle is to the right where the intake manifold is located.

Figure 1:
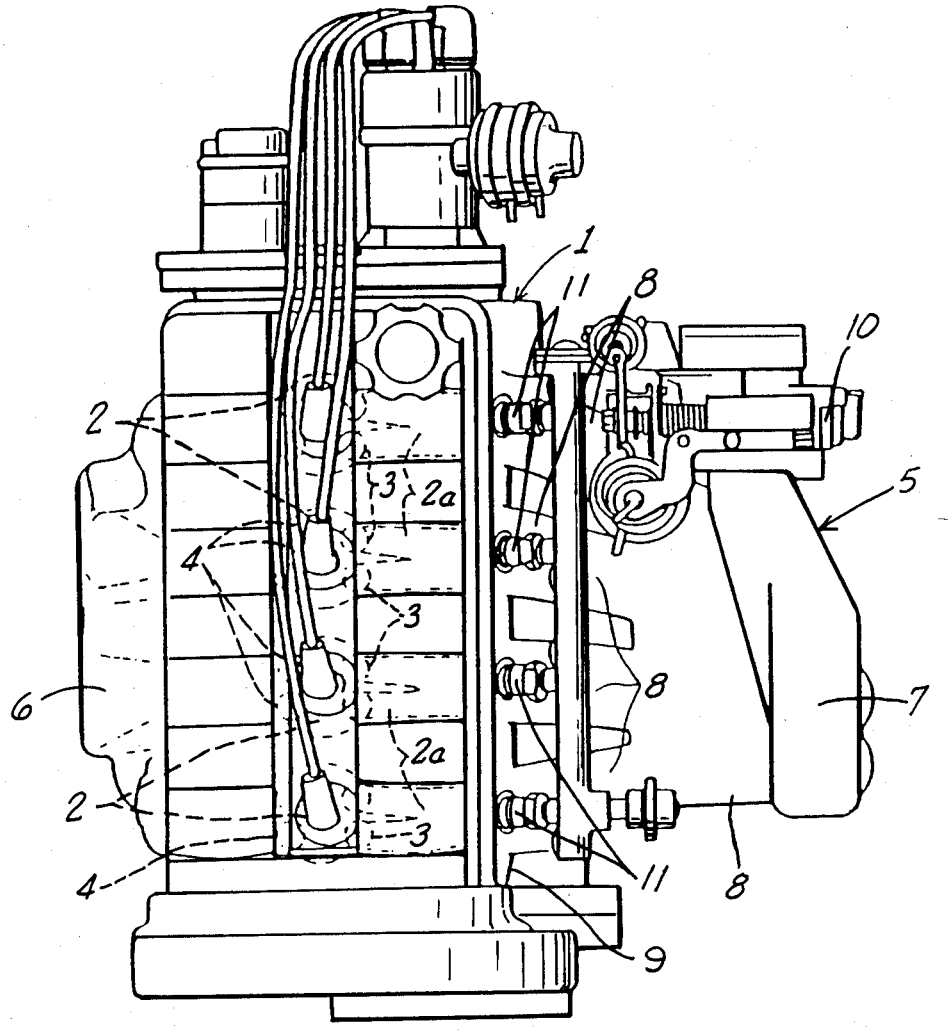
FIG. 1 is a top plan view of an engine having the intake manifold of this invention.
Figure 2:
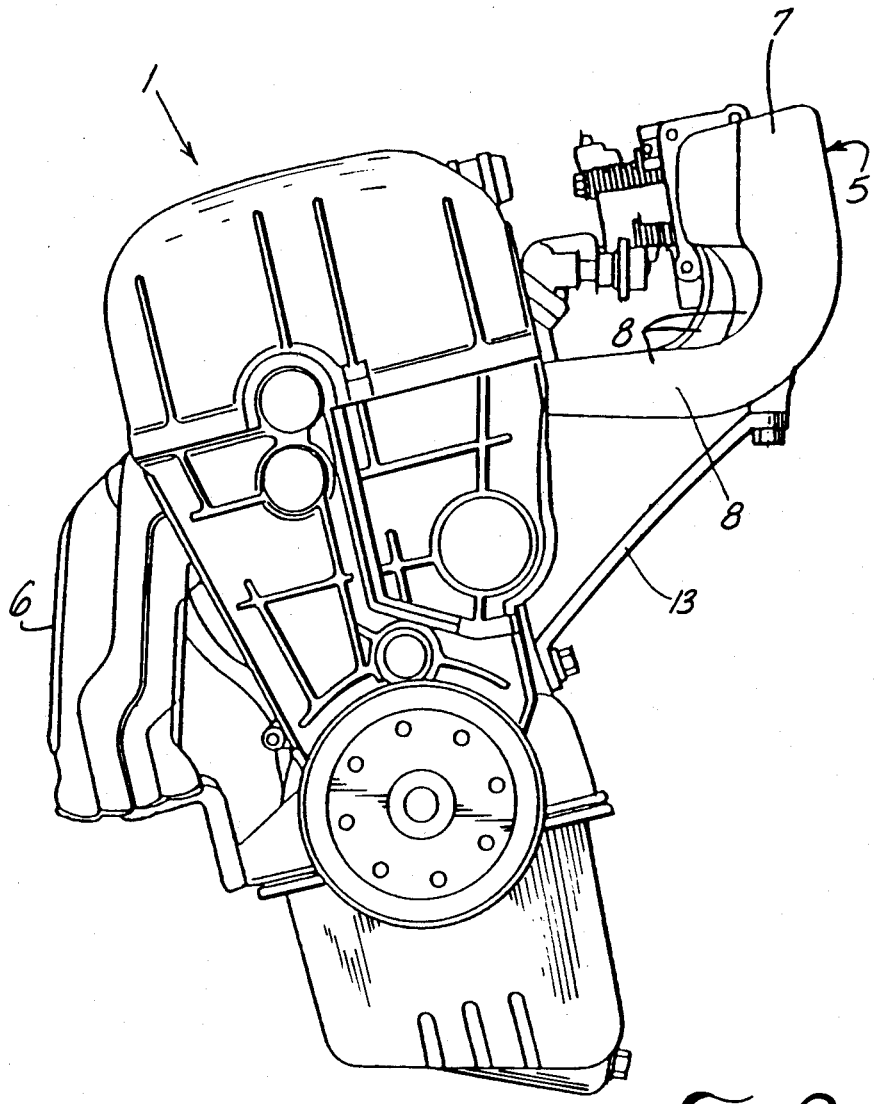
FIG. 2 is an end elevation view of the engine of FIG. 1.

Referring now to FIGS. 1 and 2, the four cylinder engine 1 includes an in-line row of four cylinders with each cylinder 2 having two intake valves 3 arranged at the rear portion and two exhaust valves 4 arranged at the front portion of the engine. An intake manifold 5 is provided at the back of the engine 1 and an exhaust manifold 6 is provided on the front side.

The intake manifold 5 includes a distribution chamber 7 which is disposed longitudinally with respect to the row of cylinders, namely in the lateral direction of the vehicle, an intake pipe 8 connected to each cylinder from the chamber 7, and a flange 9 on the end of each intake pipe 8. Each flange 9 of the manifold 5 is connected to the back of the cylinder head of the engine 1 and each intake pipe 8 opens into the intake port of each cylinder 2 on the back surface of the cylinder head. A throttle body 10 is attached to the open end of the chamber 7, so that air from an air cleaner (not shown) is supplied to the chamber 7 through the throttle valve within the throttle body 10. The fuel is injected into the air which is channelled from the chamber 7 into each intake pipe 8 from a fuel injection valve 11 mounted in a bore 11*a* on the forward end portion of each intake pipe 8. A fuel supply manifold 12 is connected to and supplies fuel to the four injection valves 11 and that fuel supply manifold is supported on bosses 12*a* on intake manifold 5. The fuel-air mixture is introduced to two intake valves 3 provided for each cylinder 2 through the intake port 2*a* of each cylinder 2 and the branching passages which connect to the intake port 2*a* from each of the two intake valves 3. A supporting member 13 extends between and is bolted onto both the engine 1 and the intake manifold 5 for bracing and supporting the intake manifold 5 from below.

Figure 3:
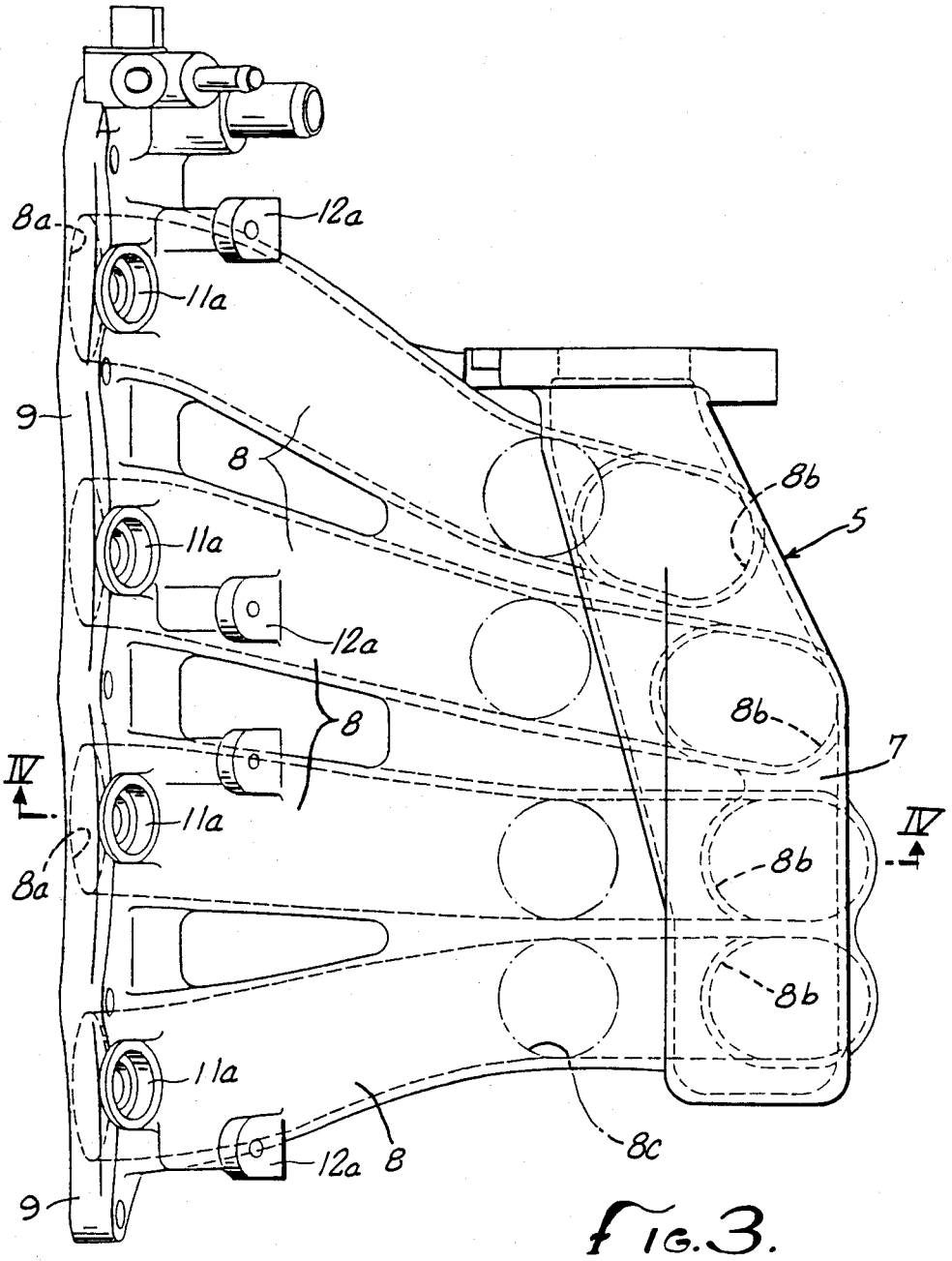
FIG. 3 is a top plan view of the intake manifold of this invention separate from an engine.
Figure 5:
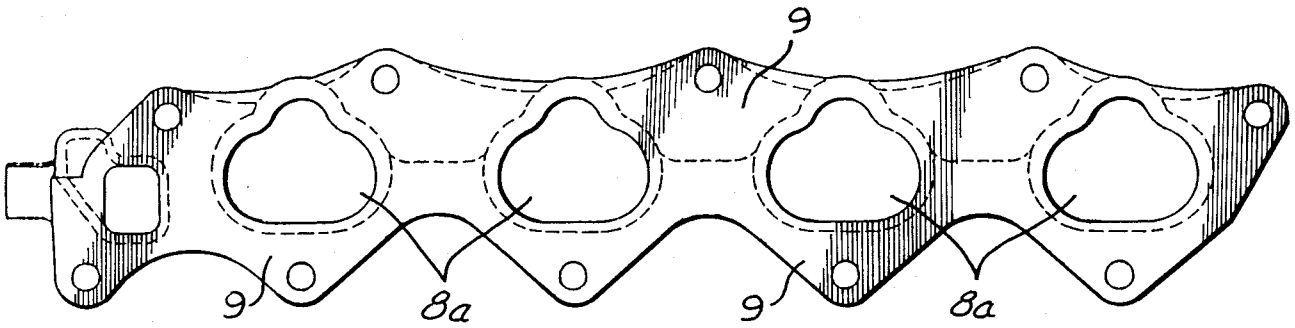
FIG. 5 is a side elevation view of the intake manifold taken substantially in the direction of the arrow V of FIG. 4.

According to one feature of the invention, the cross section of the forward end portion 8*a* of each intake pipe 8 connecting to the intake port 2*a* of each cylinder 2 is made substantially in the shape of an oval with the major axis thereof disposed in alignment with the row of cylinders, as is shown in FIG. 5. The cross section of the rear end portion 8*b* of each intake pipe 8 connecting to the chamber 7 is substantially oval with the minor axis disposed in the lateral direction, as is shown in FIG. 3. The cross section of the middle portion of each intake pipe 8 is substantially circular, as shown by the phantom lines 8*c*, and the cross section is gradually varied in shape from that middle portion toward the forward end portion and the rear end portion, respectively.

It is advantageous to gradually increase the cross section of the intake pipe 8 from the forward end to the rear end, because the output in the high rotation range is thereby heightened. As a result of the side-by-side position of the intake valves 3 and the converging intake passages in the cylinder head, the intake port 2*a* is preferably in the shape of an oval with the major axis disposed parallel to the row of cylinders and which corresponds to the oval forward end portion 8*a* of each intake pipe 8.

Figure 4:
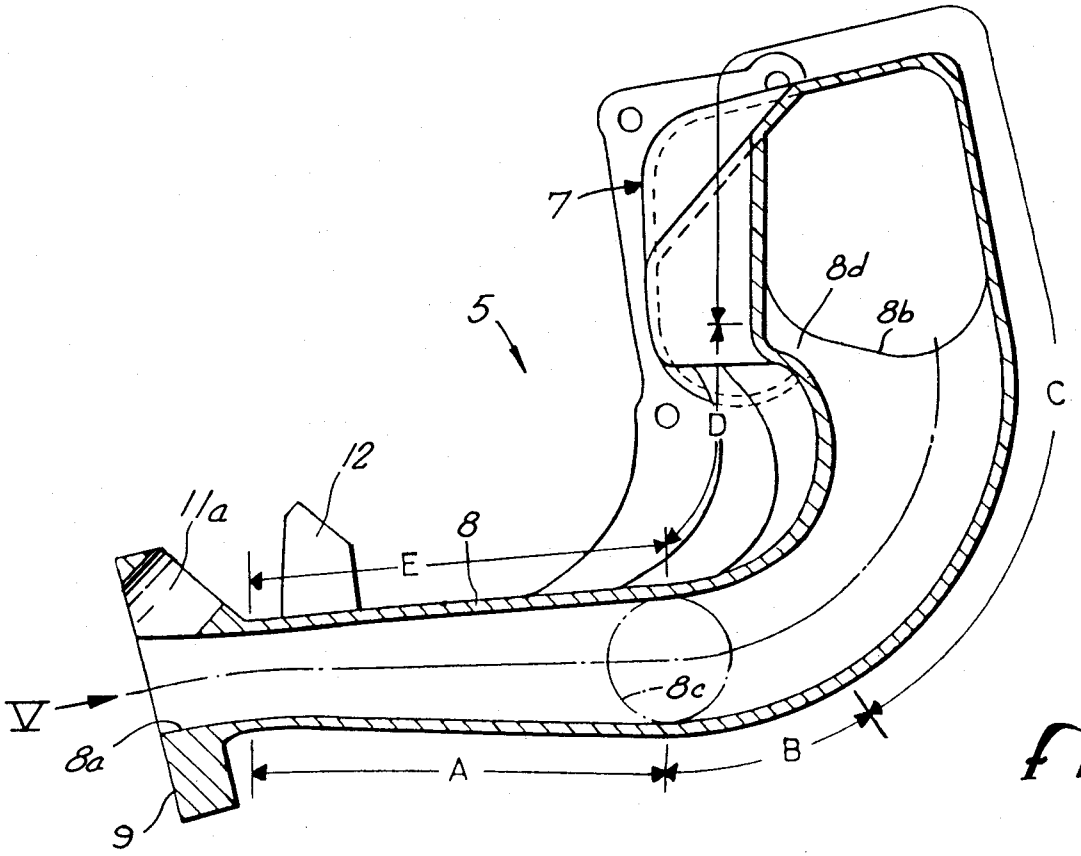
FIG. 4 is a sectional elevation view of the intake manifold taken substantial on the line IV—IV of FIG. 3.

Furthermore, as is shown in FIG. 4, the rear end portion 8*b* of each intake pipe 8 is bent substantially into an L-shape along a vertical plane including the major axis of the cross sectional oval of rear end portion 8*b* and the dimension of the major axis of the cross section is gradually increased in the direction of the inner curve of the bent portion, namely in the direction of the engine 1, toward the opening end which connects to the distribution chamber 7, whereby the rear end portion 8*b* is in the shape of an air funnel with the sectional area increasing at 8*d* at a comparatively large rate toward the chamber 7.

Another feature or characteristic of this invention is in integrally casting the intake manifold 5 with varying wall thicknesses to achieve specific desirable results. As noted above, the intake pipes 8 extend forwardly from the lower portion of the distribution chamber 7 such as to be bent into a substantially L-shape. The body of the intake manifold 5 is divided into a portion A, which is the lower wall of the straight portion at the end of each intake pipe 8, a portion B, which is the outer wall of the bent portion of each intake pipe 8 and connecting to the portion A, a portion C, which leads from the portion B extending over the entire peripheral wall of the distribution chamber 7, a portion D, which is the inner wall of the bent portion of each intake pipe 8, and a portion E, which is the upper wall of the straight portion of each intake pipe 8, all as shown in FIG. 4. The thickness of the portion A is gradually decreased from flange 9 toward the rear end from 5 mm to 4 mm and the wall thickness of the portion B continues to decrease from 4 mm to 3 mm. The thickness of the portion C is constant at 3 mm and the thickness of the portion E is gradually decreased toward the rear end portion from 5 mm to 4.5 mm.

When the body of intake manifold 5 is formed by gravity casting, molten metal is poured from the cavity corresponding to the flange 9. It has been found that the flow of the molten metal is apt to be poor at the portion D since the radius of its curvature is small. For this reason, the thickness of the middle of the portion D is increased substantially, namely to 5 mm, beyond the thickness required for strength of the portion.

As a result of this variation in wall thickness of the intake manifold 5, the weight is reduced and the center of the moment of inertia is moved closer to the engine body. In a conventional manifold, when the moment of inertia of the manifold body in relation to the end of the intake pipes 8 becomes large, or the rigidity of the body of the intake pipes is reduced, any engine vibration causes comparatively large vibration of the distribution chamber portion 7, which can be a major problem for the auxiliary means for fuel control, such as a throttle sensor (not shown), attached to the distribution chamber portion 7 as in an EFI engine. According to the invention, however, since the thickness of this portion of the intake pipes is relatively thick, the rigidity of the end portion is improved to accommodate the bending moment. Further by making the thickness of the walls of the distribution chamber portion 7 thin, the weight of the manifold body is reduced and the distance is shortened between the center of gravity and the flanges 9 of the intake pipes 8 which support the manifold from the engine, and thus the moment of inertia of the manifold body in relation to the flange ends of the intake pipes is reduced, whereby the vibration of the distribution chamber 7 is minimized and its resistance to vibration is improved.

The operation of the intake manifold according to the present invention from an air intake operation and efficiency now will be explained with reference to the above-described embodiment. The air from the distribution chamber 7 is supplied from the open end of each intake pipe 8 which has an oval cross section 8*b* with its major axis disposed in the lateral direction of the engine to the intake port 2*a* having an oval configuration with the major axis in the longitudinal direction corresponding to the open end 8*a* of each intake pipe 8 and is introduced to the two intake valves 3 of each cylinder 2 through the branching passages which connect to the intake port 2*a*. Since there is no rapid change in the cross section of the intake passage leading from the distribution chamber 7 to the two intake valves 3, charging efficiency is improved. Furthermore, since the rear end portion 8*b* of each intake pipe 8 is formed with an oval configuration with its major axis disposed in the lateral direction relative to the distribution chamber 7, the pitch between each intake pipe with respect to the distribution chamber 7 is reduced and thus the length of the chamber 7 can be shortened even though the cross-sectional area of each intake pipe 8 is gradually increased from the forward end to the rear end, as described above, such that the length of the chamber including the throttle body 10 is within the length of the engine 1.

In addition, by forming the rear end portion 8*b* of each intake pipe 8 in the configuration of an air funnel, the length of the chamber 7 is minimized. The air funnel is formed such that its rear end portion 8*b* is bent into an L-shape and the length of the major axis of the oval configuration of the rear end portion 8*b* is gradually increased in the direction of the inner curve of the bent portion whereby the chamber 7 is displaced toward the inner curve of the bent portion, namely in the direction toward the engine 1, and the overhanging length of the manifold 5 in relation to the engine 1 is shortened, whereby the vibration, which is a great problem in the high rotational range, is reduced.

As has been described above, according to the invention, there is no rapid change in the configuration of an intake passage in cross section which leads from the distribution chamber to the plurality of valves of each cylinder through corresponding intake pipes, charging efficiency is heightened, and the length of the distribution chamber is shortened, which reduces the space required by the engine as a whose. Furthermore, the rear end portion of each intake pipe is formed in the configuration of an air funnel without increasing the length of the distribution chamber, and the overhanging length of the intake manifold in relation to the engines is reduced, which brings about such advantages as heightened output in the high-rotation range and reduced vibration of the manifold which is apt to be caused in the high-rotation range. Still further, by progressively reducing the wall thickness of the manifold as the distance from the engine increases, the weight and moment of inertia are reduced to further reduce vibration problems.

The invention claimed is:

1. An intake manifold employed for a multicylinder in-line engine having an oval intake port for each cylinder with each oval intake port having a major axis extending longitudinally in relation to a row of cylinders, comprising a distribution chamber adapted for mounted disposition on said engine with its longitudinal axis generally parallel to the major axes of said intake ports, one intake pipe for each cylinder communicating with said distribution chamber and extending laterally therefrom, a forward end portion on each intake pipe for connecting to said oval intake port of each said cylinder having a substantially oval shape with the major axes of said forward end portions being mutually aligned in a direction substantially parallel to said row of cylinders, and a rear end portion on each said intake pipe connected to the distribution chamber having a substantially oval shape with the minor axes of said rear end portions being mutually aligned in a direction substantially parallel to said row of cylinders.

2. An intake manifold according to claim 1, wherein the cross sectional area of said intake pipe is gradually increased from said forward end portion to said rear end portion.

3. An intake manifold according to claim 2, wherein the cross section of a portion of each intake pipe between said forward end and rear end portions is substantially circular.

4. An intake manifold according to claim 1, wherein each intake pipe has a wall of varying thickness with the thickness being generally reduced from the forward end portion toward the rear end portion.

5. An intake manifold according to claim 4, wherein the distribution chamber has a wall of a thickness substantially equal to the thinnest wall thickness of said intake pipes.

6. An intake manifold according to claim 5, wherein the thinnest wall is approximately 3 mm thick and the thickest wall is approximately 5 mm thick.

7. An intake manifold employed for a multicylinder engine with the cylinders aligned in a longitudinal row and having at least two intake valves on one cylinder, including a distribution chamber which is disposed longitudinally in relation to the row of cylinders with one intake pipe for each cylinder being branched from said chamber, comprising, a forward end portion on each intake pipe for connecting to said intake port of each of said cylinders and being formed in a substantially oval shape with the major axes of said forward end portions being mutually aligned in a direction substantially parallel to said row of cylinders, a rear end portion on each said intake pipe connected to said distribution chamber and formed in a substantially oval shape with the minor axes of said rear end portions being mutually aligned in a direction substantially parallel to said row of cylinders, said rear end portion of each said intake pipe having a bent portion of a substantially L-shape along a vertical plane including the major axis of said cross sectional oval configuration on that rear end portion, and said major axis of said cross sectional oval configuration of the rear end portion being gradually increased in the direction of an inner curve of the bent portion toward connection to said distribution chamber.

8. An intake manifold according to claim 7, wherein each intake pipe opens into the distribution chamber in the shape of a funnel of an increasing major axis in the direction of the distribution chamber.

9. An intake manifold according to claim 7, wherein the cross sectional area of said intake pipe is gradually increased from said forward end portion to said rear end portion.

10. An intake manifold according to claim 9, wherein the cross section of a portion of each intake pipe between said forward end and rear end portions is substantially circular.

11. An intake manifold according to claim 7, wherein each intake pipe has a wall of varying thickness with the thickness being generally reduced from the forward end portion toward the rear end portion.

12. An intake manifold according to claim 11, wherein the distribution chamber has a wall of a thickness substantially equal to the thinnest wall thickness of said intake pipes.

13. An intake manifold according to claim 12, wherein the thinnest wall is approximately 3 mm thick and the thickest wall is approximately 5 mm thick.

14. An intake manifold according to claim 13, wherein said inner curve has a wall thickness of approximately 5 mm.

15. An intake manifold for a multicylinder internal combustion engine, comprising, an elongated distribution chamber spaced from said engine and having its longitudinal axis extending substantially parallel to the longitudinal axis of said engine, an intake pipe for each cylinder connected to and extending outwardly from said distribution chamber along the longitudinal axis thereof, each intake pipe having an inlet end at the distribution chamber and an outlet end for connecting to the engine, said inlet end being generally oval with a major axis approximately perpendicular to the longitudinal axis of the distribution chamber, and said outlet end being generally oval with a major axis extending approximately parallel to the longitudinal axis of the distribution chamber.

16. The intake manifold of claim 15 wherein said inlet ends are grouped and connected to said distribution chamber in a shorter distance longitudinally than said outlet ends extend longitudinally.

17. The intake manifold of claim 16 wherein said inlet ends are funnel shaped in the plane of the major axis.

18. The intake manifold of claim 16 wherein each intake pipe has a wall thickness which decreases in the direction from said outlet end to said inlet end.

19. The intake manifold of claim 16 wherein a bore is provided in each outlet end for a fuel injection valve which bore is located at an edge of and intersects the oval on the minor axis.

* * * * *